US006557291B2

(12) United States Patent
Hoadley

(10) Patent No.: US 6,557,291 B2
(45) Date of Patent: May 6, 2003

(54) SIGHT APPARATUS FOR GUNS AND ARCHERY BOWS

(76) Inventor: Francis Brent Hoadley, Route 1, Box 166-A, Lamont, FL (US) 32336

( * ) Notice: Subject to any disclaimer, the term of this patent is extended or adjusted under 35 U.S.C. 154(b) by 0 days.

(21) Appl. No.: 09/993,799

(22) Filed: Nov. 23, 2001

(65) Prior Publication Data

US 2002/0056220 A1 May 16, 2002

Related U.S. Application Data

(63) Continuation-in-part of application No. 09/585,783, filed on Jun. 5, 2000, now abandoned.

(51) Int. Cl.[7] ..... F41C 27/00
(52) U.S. Cl. ..... 42/111
(58) Field of Search ..... 42/111, 133, 144; D22/109

(56) References Cited

U.S. PATENT DOCUMENTS 2,351,103 A * 6/1944 Brown ..... 124/23.1
4,745,698 A * 5/1988 Schwulst ..... 42/131
4,850,113 A * 7/1989 Doll ..... 42/111
5,068,968 A * 12/1991 Sillery ..... 42/111
D406,630 S * 3/1999 Emerson ..... D22/100
5,930,906 A * 8/1999 Howe et al. ..... 42/132
6,321,479 B1 * 11/2001 Sheehan ..... 42/111

* cited by examiner

*Primary Examiner*—Charles T. Jordan
*Assistant Examiner*—Kimberly S. Smith
(74) *Attorney, Agent, or Firm*—Brian D. Bellamy

(57) ABSTRACT

A sight apparatus comprising a mount, and a sight mechanism, which may be removable. The sight mechanism including a proximal end and a distal end bounding a central portion, which may be enlarged. The sight mechanism set in a position within the mount via contact with the central portion. The sight mechanism including a circular aperture passing through the proximal end, the central portion, and the distal end of the sight mechanism. An interchangeable proximal circular member may be attached to the proximal end of the sight mechanism, and an interchangeable distal circular member may be attached to the distal end of the sight mechanism.

14 Claims, 5 Drawing Sheets

2
4

2
6

8
64
10
14
64
12
10

SIGHT APPARATUS FOR GUNS AND ARCHERY BOWS

PRIORITY CLAIM

The present application is a continuation in part of U.S. patent application Ser. No. 09/585,783 filed on Jun. 5, 2000 now abandoned and entitled Unitized Sight Apparatus.

BACKGROUND OF THE INVENTION

1. Field of the Invention

This invention relates to a sight apparatus to be used with firearms, archery bows and other weapons or hunting instruments. It is more particularly concerned with a sight apparatus that centers a target using the natural characteristics of the human eye, and the sight apparatus is adaptable to a variety of instruments.

2. Discussion of the Prior Art

Non-optical sight devices are popular because they are inexpensive and easy to use. However, prior non-optical sight devices used with weapons and hunting devices display several limitations overcome by the present invention and place the human eye at a disadvantage.

Sight devices comprising rear and front alignment members such as a rear notched member and front post sights are very common, but these devices force the human eye to focus and align to the post, which represents a very close object. While the human eye is focused on a very close object, the intended target is typically distant. The focus on the close object negatively effects the ability of the human to properly focus and align on a distant target.

Attempts have been made to improve sight devices similar to the notched rear sight member with front sight post design. For instance, luminescent materials have been provided on the post or device for use in darkened conditions as in U.S. Pat. No. 3,641,676 to Knutsen and Santiago. These luminescent materials aid in rear sight and front sight alignment, but still force the human eye to focus and align two objects that are closer to the human eye than the target. More recent designs that suggest using luminescent outlines and dots in gun sights to align a target also force the human eye to focus on the closer image of the sight device rather than the target. Thus, professional handgun shooters usually have a clear picture of the sight device or the target, but not both.

Still other examples exist of similar sight devices with these drawbacks. For example, U.S. Pat. No. 3,777,380 to Paris Theodore employs a rear v-shaped notch connected by a block with a channel groove used for alignment with a target, and U.S. Pat. No. 4,918,823 to Julio A. Santiago adds a post to a similar channel sight device. These type of non-optical sights continue to depend on the human eye lining up closer objects and demand the eye to focus on those closer objects to center a distant object, causing the distant target to remain out of focus. The problem is further exacerbated when a person is nearsighted or farsighted causing the person to readily misalign a sight picture. Sights having a front sight ring and a rear sight ring are well-known, but very similar to sights having front and rear alignment members. U.S. Pat. No. 3,744,143 to David D. Kilpatrick describes a front sight ring and rear sight ring that when perfectly aligned by the shooter's eye provides a clear sight picture. The rings in the '143 patent are not connected without longitudinal alignment by the shooter's eye, and, therefore, the human eye has to align the closer ring objects to focus a clear sight picture, similar to front and rear alignment member schemes discussed above. Such sight rings are disadvantageous also because they are subject to snagging. U.S. Pat. No. 4,215,495 to Donald G. Wagner connects two holes in sheet metal arms in a fixed assembly, which still requires alignment of two closer sight objects by the eye, rather than allowing the eye to focus on the distant target.

Another variety of non-optical sight devices that are well-known in the prior art are tubular sights and modifications thereto that provide a tunneling effect for aligning a target. For example, U.S. Pat. No. 4,048,726 to Albert W. LeFebure shows a sight tube for a bow, and U.S. Pat. No. 5,471,777 to Kenneth E. McDonald shows a sight tube for a firearm towards the muzzle end of the firearm to reduce dominant-eye misalignment. While a tube may reduce dominant eye misalignment, a tubular sight generally causes a tunneling effect that requires maintenance of constant and equal shadow as the tube gets longer causing a common misalignment problem. The tube's diameter or radius from the center appears to get smaller because the human eye naturally narrows the aperture at the distal end of the tube, making sighting and alignment of a target more difficult. Enhancement such as lights, dots, posts and other alignment members have been proposed but only confuse the sight picture even further.

Optical devices and light projecting sights provide a solution to some of the problems discussed. However, optical devices such as lenses, mirrors, and telescopic devices which aid the human eye are generally more expensive and limited to use in certain environmental conditions. Light projecting sights such as lasers allow the use of the full function of the human eyes but like optical devices are expensive and may not be used under all light conditions. Further, such optical devices and light projecting sights are often bulky and encumber the sleek profile of a gun or bow.

As discussed, prior art sighting mechanisms are either very expensive or compromise the natural abilities of the human eye, leading to a less desirable sighting device. Therefore, a need exists for an sighting apparatus that is inexpensive to manufacture. In particular a non-optical sighting apparatus is needed that does not require the alignment of closer sight members or objects closer than the target or provide a tunneling effect.

The inventor has found that the optimal sighting apparatus should utilize the natural abilities of the human eye to align a target in the center of a unitized longitudinal circular sight. In order to have an accurate sighting device, the user's eye must see a perfectly aligned sight picture automatically and should focus on the target. The human eye should not be forced to focus on objects that are closer than the target. Further, the sight picture should not be encumbered by any objects such as post members.

A desirable sighting device should be unobtrusive, cheap to manufacture, and adjustable. The sighting device should enhance profile of weapon and should not be prone to snag. Further, the sighting device should be adaptable to a variety of weapons including firearms and archery bows, and should be adaptable to integrate with or supplement a weapon or hunting device.

SUMMARY OF THE INVENTION

The present invention allows a user's eye to perfectly align a sight picture automatically. The sight apparatus of the invention relies on the natural ability of the human eye to center an object in a field of vision as seen through a circle, while allowing the eye to focus on the target without obstruction. The sight apparatus provides a non-optical sight device that is inexpensive to manufacture and highly adaptable to supplement or incorporate into a variety of weapons and hunting instruments, such as pistols, rifles, and archery bows. Further, the sight apparatus taught herein is unobtrusive when adapted to a surface and is not prone to snag is deface the profile of the instrument.

The sighting apparatus includes a mounting assembly having a base for securing the sight apparatus to a surface such as on a gun or bow. A retaining member on the mounting assembly is removable or may be opened to accommodate a replaceable internal sight mechanism that is set within the base. Enhancements to the mounting assembly may be made to optimize light, such as a pattern of apertures or provision of light collecting material.

The internal sight mechanism includes a central portion with an enlarged girth for securing the sight mechanism with respect to the base and the retaining member. In the preferred embodiment the central portion has an elliptical shape. The elliptical shape of the central portion provides for the sight mechanism to have a proximal end and a distal end separated by the central portion, and the proximal end and the distal end each have an external girth that is reduced with respect to the enlarged girth of the central portion.

The enlarged girth of the central portion assists in securing the internal sight mechanism to the mounting assembly, and slip resistant material may be added to the central portion to assist in securing the sight mechanism. Set screws through the mounting assembly contact the central portion to affix the sight mechanism in position.

The reduced girth of the proximal and distal ends provide excellent location points for windage and elevation adjusting devices to contact the internal sight mechanism and operate for adjusting the sighting apparatus. Such windage and elevation adjustment devices are set in the mounting assembly in operable relation to the sight mechanism.

The sight mechanism includes a circular aperture that passes through the proximal end, the central portion, and the distal end. A proximal circular member providing a perfect circle for the human eye to view the target through is attached to the proximal end of the sight mechanism. The proximal circle member has an aperture that is perfectly aligned in contiguous relation to the circular aperture of the sight mechanism. A distal circular member providing a perfect circle is attached to the distal end of the sight mechanism and has an aperture that is perfectly aligned in contiguous relation to the circular aperture of the sight mechanism. The proximal circular member and distal circular member are removable.

When the circumstances cause the configuration of the circular members and internal sight mechanism to present a tunneling effect, the circular members may be easily removed from the internal sight mechanism and replaced with circular members that are shorter longer. Thus, the sight apparatus may be adapted without effecting the adjustment of the windage and elevation or the alignment of the sight. Alternatively, the internal sight mechanism may be completely removed and replaced with one that is shorter or longer or provides a different aperture size.

In operation the longitudinal aperture through the internal sight mechanism combined with the circular member are not long enough for human eye to narrow sides of distal end and cause a tunneling effect. Therefore, any view or shadow of the sides of the proximal circle member destroys the perfect circle and indicates misalignment with the target. Likewise, if any edges the of distal circle member become prominent in the sight picture, the sight picture is misaligned.

DETAILED DESCRIPTION OF THE INVENTION

Figures 1, 2, 3:
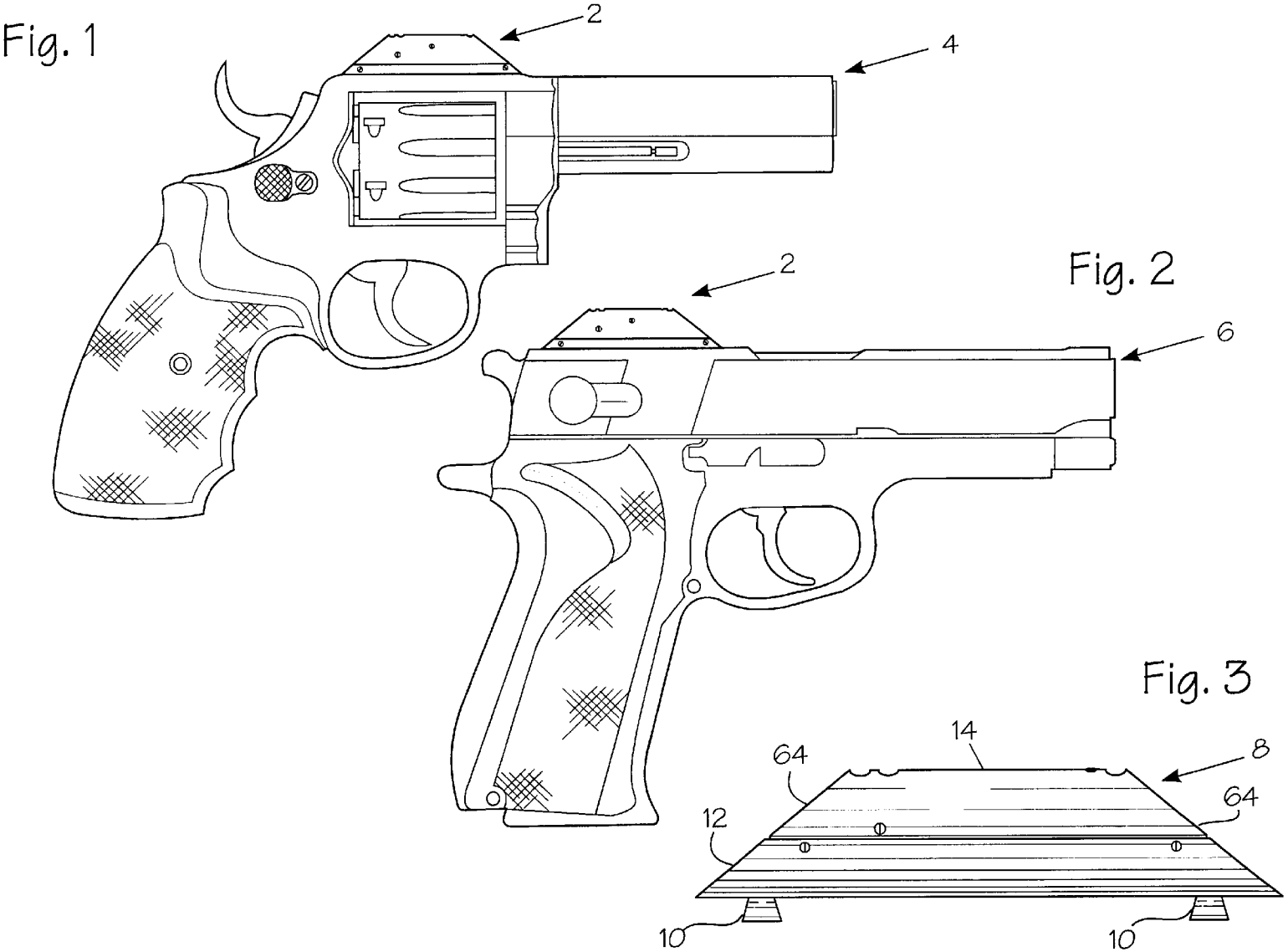
FIG. 1 is a side elevational view of a sight apparatus for firearms and archery bows in accordance with the present invention shown mounted onto a revolver.
FIG. 2 is a side elevational view of a sight apparatus in accordance with the invention shown mounted onto a semi-automatic pistol.
FIG. 3 is a side elevational view of a sight apparatus in a unitized configuration depicting the external portion of the sight apparatus.

Referring to FIG. 1 a preferred embodiment of the sighting apparatus 2 of the invention is illustrated attached to a revolver 4, and in FIG. 2 the sighting apparatus 2 is attached to a semi-automatic pistol 6. In addition to the representations in the figures, the sighting apparatus 2 may be attached to a variety of weapons and hunting instruments, including rifles and bows, that require accurate target alignment. The external portion of the sight apparatus 2 is depicted in FIG. 1 and FIG. 2, which is the mounting assembly 8. One arrangement of the mounting assembly 8 as may be used in the invention is shown enlarged and assembled in FIG. 3 having dovetail members 10 for attaching the mounting assembly to a surface. The mounting assembly includes a base 12 and a retaining member 14.

Figure 11:
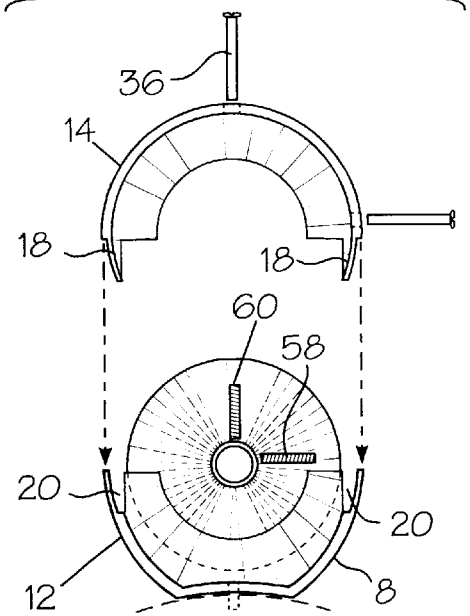
FIG. 11 is an assembly and cross-sectional end view of the sight apparatus similar to FIG. 9 in another embodiment having a rounded base for tap and die attachment to the barrel of a gun.
Figure 15:
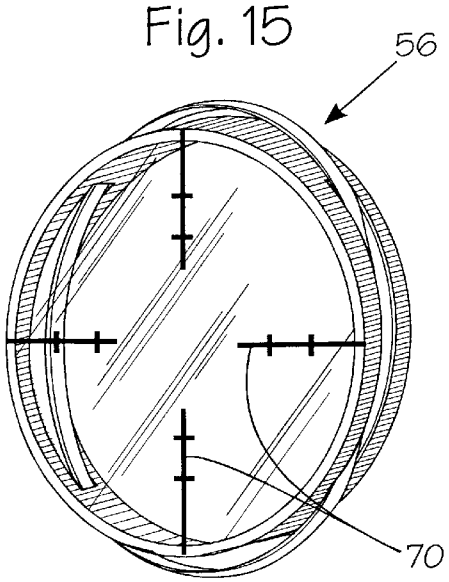
FIG. 15 is a perspective view of a clear lens with range finding mechanism attached to the distal circular member.
Figure 14:
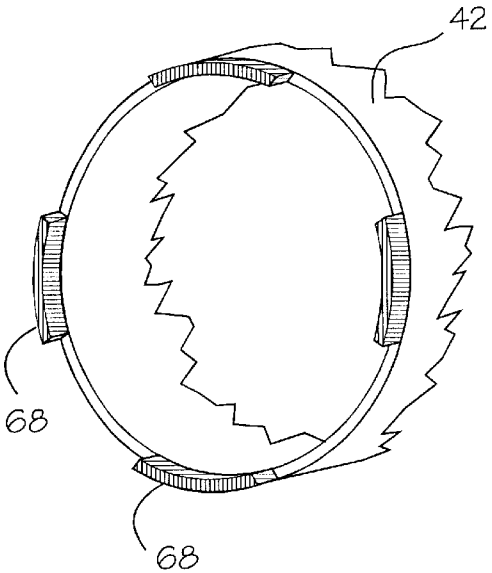
FIG. 14 is a fragmentary perspective view of a circular member with light collecting members on the distal end of the sight apparatus.
Figure 13:
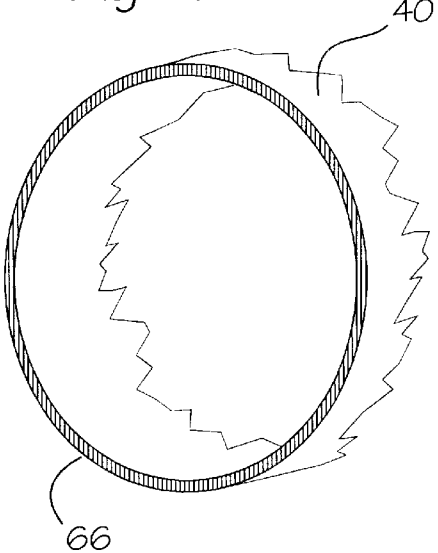
FIG. 13 is a fragmentary perspective view of a circular member on the proximal end of the sight apparatus.

The mount 8 serves to contain, preserve and optimize the usefulness of the sighting mechanism 16 held thereby. In the preferred embodiment, the mount 8 consists of an assembly or mounting assembly 8 that provides an external shape for the sight apparatus 2 that enhances the profile of the overall instrument, and does not offer appendages that may easily snag. The base 12 of the mounting assembly 8 may be shaped to provide for attachment to a variety of weapons and by a variety of methods. As shown in FIGS. 3 and 6–9, the base 12 may attach by male dovetail members 10 to a female base on the surface of a gun barrel. As shown in FIG. 11, the base 12 may be rounded and a tap and die attachment means used to affix the base to rounded gun barrel. Alternatively, the mounting assembly 8 may be adapted to receive a clamp or ring or other external device to affix the mounting assembly 8 to a surface. The mounting assembly could also be designed as an integrated part of a larger implement so that the base, for instance, is contemplated by the design of the implement.

In some cases, it may be desirable for the internal sight mechanism 16 to be completely removable and replaceable by one with different characteristics, such as a sight mechanism that is shorter, longer, or having a different aperture size. In the preferred embodiment disclosed in the drawings, the mounting assembly 8 is configured to allow for interchange and exchange of the internal sight mechanism 16. In particular, the retaining member 14 is provided such that a part of the mounting assembly 8 may be hinged, pinned, or slotted to be removable. Thereby, the retaining member 14 may be opened or removed to replace the internal sight mechanism 16 with one more advantageous for the user's circumstances. One embodiment for attaching the retaining member is shown in FIGS. 6–9 in which flange members 18 on the retaining member are received by the channels 20 and screws 22 are received by the threaded holes 24.

In the preferred embodiment illustrated, the interior of the base 12 and retaining member 14 of the mounting assembly 8 are shaped to receive the internal sight mechanism 16 securely. With the internal sight mechanism 16 having a portion that is elliptically shaped, a portion of the base 12 may be shaped to provide a concave inner surface 26 to receive the internal sight mechanism 16. In complementary fashion, the retaining member 14 may have a concave inner surface 28 to fit over the internal sight mechanism 16 securely.

The mounting assembly 8 may be designed to enhance the amount of light reaching the internal sight mechanism 16. For example, the mounting assembly 8 may be constructed of transparent material or may include a pattern of several apertures 30 for collecting light. The proximal and distal ends 64 of the mounting assembly 8 may be sloped or rounded to enhance the design, prevent snagging, and also increase the amount of light reaching the internal sight mechanism 16.

As shown, the mounting assembly 8 includes set screws 32 therein to secure the internal sight mechanism 16 with respect to the mounting assembly 8. A windage adjustment screw 34 and elevation adjustment screw 36 are provided in the mounting assembly 8 to allow for proper adjustment of the internal sight mechanism 16.

Figure 4:
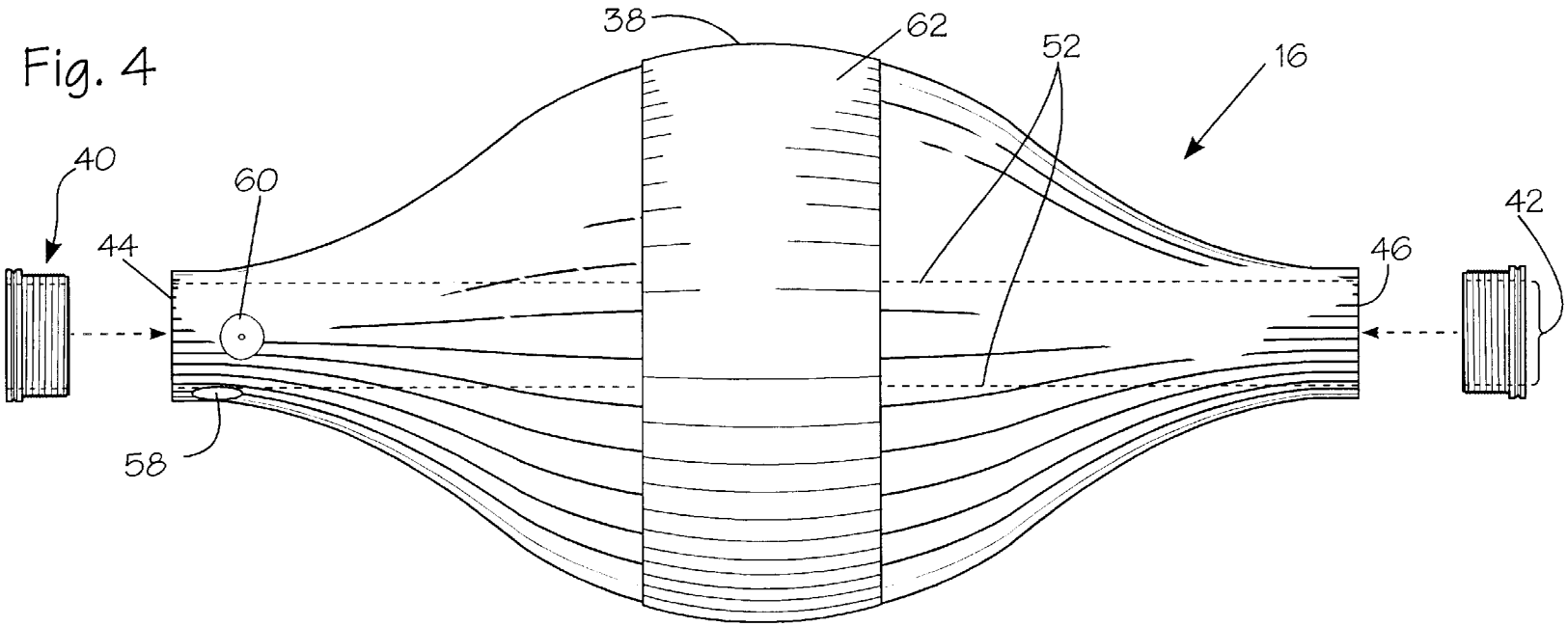
FIG. 4 is an assembly, side elevational view of the internal sight mechanism of the sight apparatus.
Figure 5:
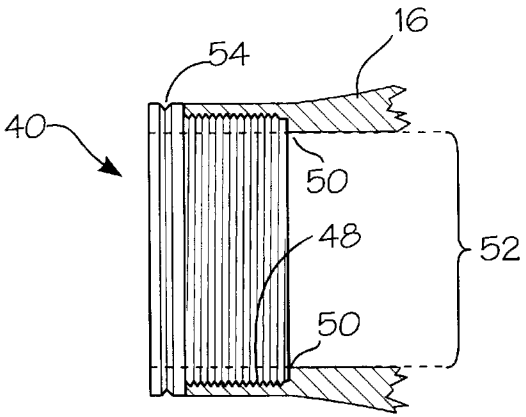
FIG. 5 is a fragmentary, enlarged cross-sectional view taken through one end of the internal sight mechanism of the sight apparatus.
Figure 7:
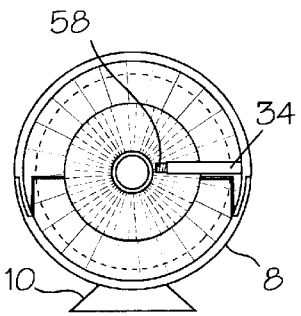
FIG. 7 is a cross-sectional end view of the sight apparatus taken along line 7—7 in FIG. 6.
Figure 9:
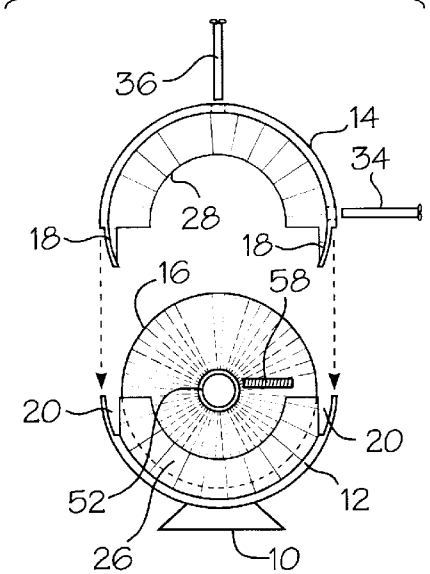
FIG. 9 is an assembly and cross-sectional end view of the sight apparatus taken along line 9—9 in FIG. 8.
Figure 6:
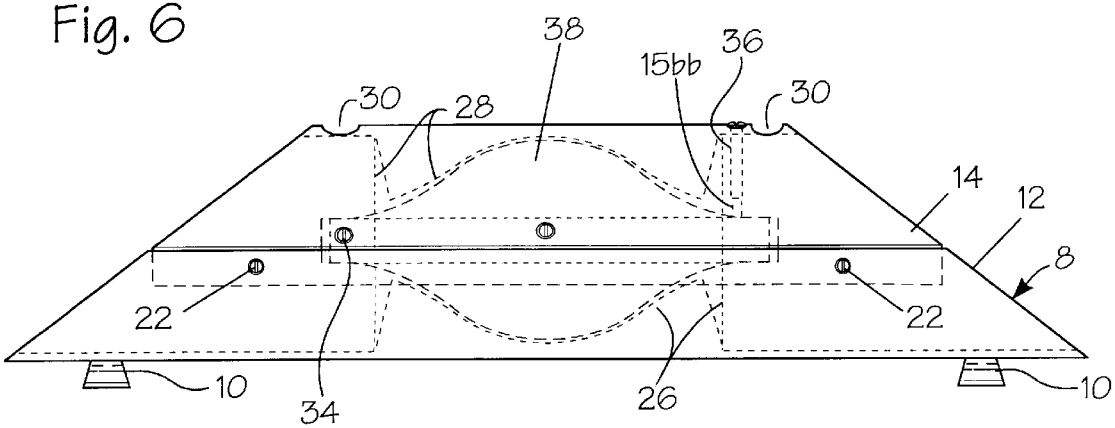
FIG. 6 is a side elevational view of the sight apparatus in a preferred embodiment showing the configuration of the internal sight mechanism within the sight apparatus.
Figure 8:
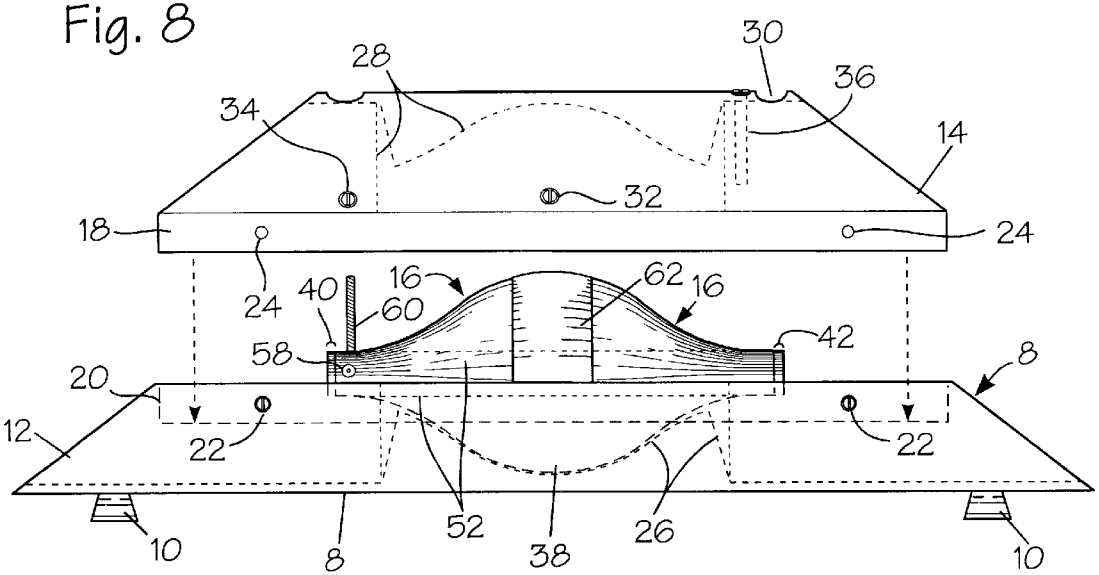
FIG. 8 is an assembly, side elevational view of sight apparatus showing the assembly of the external portion of the sight apparatus for interchange of the internal sight mechanism.
Figure 10:
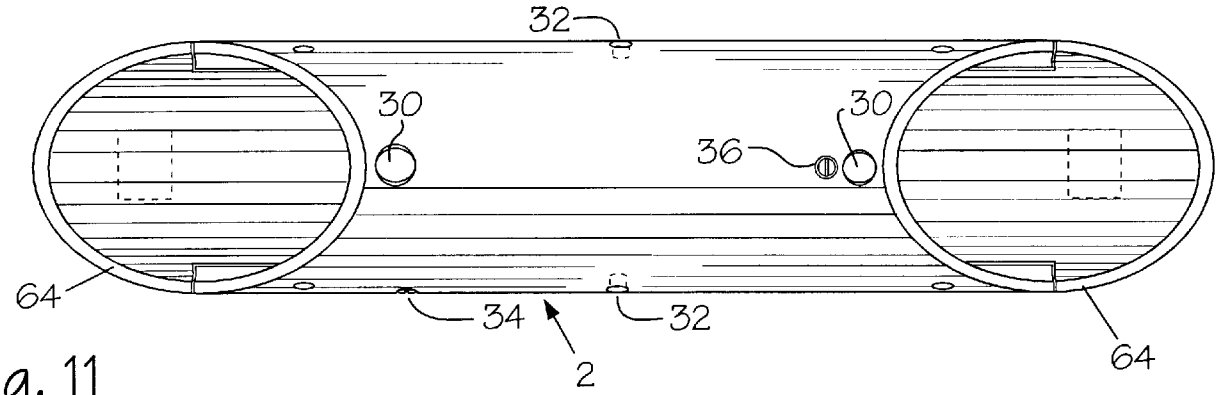
FIG. 10 is a top plan view of the sight apparatus in a unitized configuration depicting the external portion of the sight apparatus.
Figure 12:
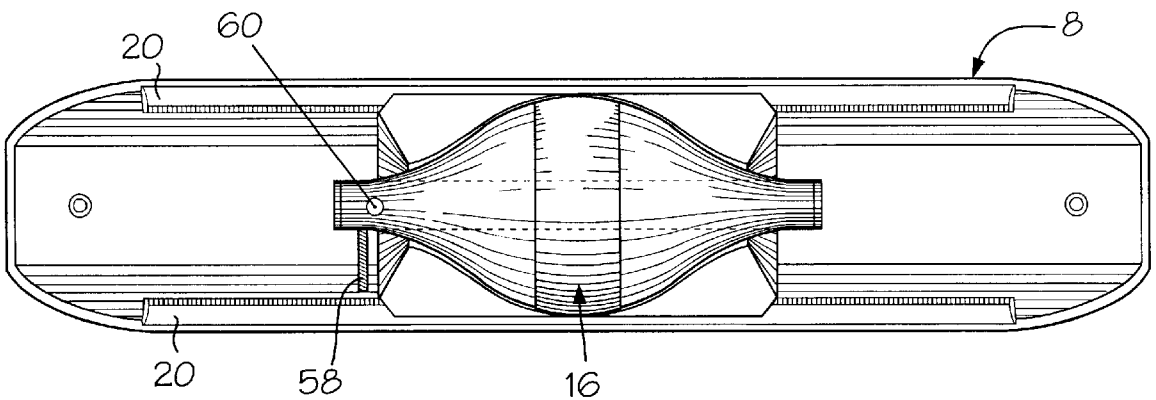
FIG. 12 is a top plan view of the sight apparatus with a top halve of the external portion of the sight apparatus removed to show the internal sight mechanism oriented within the bottom halve of the external portion of the sight apparatus.

The internal sight mechanism 16 as shown in the figures and in the enlarged FIG. 4 includes a central portion 38 that in FIG. 4 is elliptically shaped. The central portion 38 may be circular or cylindrical or modified to provide an enlarged central portion 38 having protruding extensions. Regardless, the central portion 38 may provide an enlarged girth for a section of the internal sight mechanism 16 to provide the advantages of a larger surface area in setting the sight mechanism 16 in the base 12.

The central portion 38 extends to circular members 40 and 42 which may be attached to each terminal end of the sight mechanism 16. The proximal end 44 of the sight mechanism 16 and the distal end 46 of the sight mechanism 16 are circular to match the circular members 40 and 42 for when removable circular members 40 and 42 are used. The terminal ends 44 and 46 of the sight mechanism 16 may include internal threads 48 for receiving the circular members 40 and 42. Further, the sight mechanism 16 may include internal shoulders 50 in combination with an aperture 52 that runs longitudinally as an opening through the sight mechanism 16. The shoulders 50 provide for contiguous and perfectly matched connection of the sight mechanism 16 to the circular members 40 and 42. Thus, the proximal and distal circular members 40 and 42 on the proximal and distal ends 44 and 46 of internal sight mechanism 16, respectively, are connected by a circular longitudinal opening through the sight mechanism 16. The assembly of the circular members 40 and 42 with the sight mechanism 16 provides a contiguous and perfectly matched aperture throughout.

The proximal and distal circular members 40 and 42 may be any suitable color and diameter to complement the user's needs. Preferably, the material chosen will provide color contrast and suitable light collecting properties to complement the function of the device as a sight apparatus 2. Changes in the diameter of the circular members 40 and 42 or use of color or light collecting material can aid and complement the formation of the sight alignment picture. Likewise, the distal circle member 42 may be a continuous circle, or alternatively, an interrupted circle of light gathering material that may be made to complement the function of the device. In an embodiment that would be suitable in many instances, the exposed end 66 of the proximal circular member 40 would be white to provide contrast, and the inside edge of the distal circular member 42 would be flourescent or light gathering. Flanges 68 may also be provided on the distal circular member 42, especially when the sight apparatus 2 is used in archery applications.

In addition, further enhancements to the sighting apparatus 2 may be provided. For instance, the distal circular member 42 may include a retainer such as a grooved rim 54 for receiving and holding a clear lens 56. A clear lens may be added to provide a windage and elevation guide to compensate for the distance from the target through the inclusion of grid lines 70 on the lens.

As mention previously, the central portion 38 may provide an enlarged girth for a section of the internal sight mechanism 16, thereby providing the advantages of a larger surface area in setting the sight mechanism 16 in the base 12 and securing by the retaining member 14. In particular, the internal sight mechanism 16 is secured within mounting assembly 8 by tightening the set screws 32 against the surface of the central portion 38 of the internal sight mechanism 16. In addition to the enlarged girth of the central portion 38 or as an alternative, the central portion may be provided other slip resistant features. For instance, the central portion 38 may have recesses, projections, or may be coated by a slip resistant material band 62 or knurled to enhance the ability to secure the sight mechanism 16 in the mounting assembly 8.

Further adjustments are made by the windage screw 34 and elevation screw 36 which contact a windage adjustment device 58 and elevation adjustment device 60 on the sight mechanism 16. The windage screw 34 and windage adjustment device 58 are generally close to a terminal end 44 or 46 of the internal sight mechanism and directed toward the side of the sight mechanism for easier adjustment. The windage adjustment device 58 may be integrated with internal sight mechanism 16 to cooperates with windage adjustment screw 34. The elevation screw 36 and elevation adjustment device 60 are generally close to the same terminal end of the sight mechanism 16 as the windage screw 34 and in positioned with respect to the top of the sight mechanism 16 for easier adjustment.

The elevation and windage adjustments may be accomplished with popular sight adjustment devices that could be integrated into the sight mechanism 16 such as the several forms of click-set adjustment devices that are well-known.

The present invention is operated as a sight to align a gun or projectile device with a target. The connection of the proximal and distal circular members 40 and 42 by longitudinal aperture 52 through the central portion could be considered a tube. However, the aperture 52 is not long enough for human eye to narrow sides of distal end 46. Therefore, any view or shadow of the sides of the proximal circular member 40 destroys the perfect circle that should appear around the target seen through the sight apparatus 2 and indicates misalignment with the target. Also, if the edges the of distal circular member 42 become prominent in the sight picture, the sight picture is misaligned.

Figure 20:
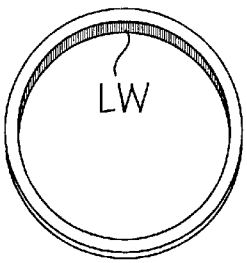
FIG. 20 is a sight picture as seen through the sight apparatus in which the target is aligned too low.
Figure 19:
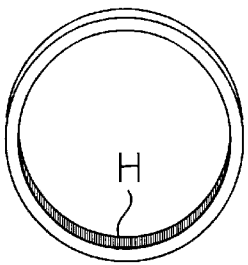
FIG. 19 is a sight picture as seen through the sight apparatus in which the target is aligned too high.
Figure 18:
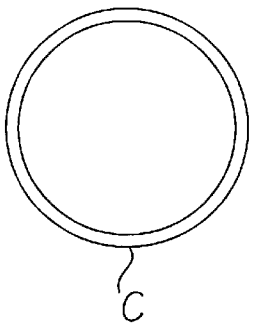
FIG. 18 is a sight picture as seen through the sight apparatus in which the target is aligned correctly.
Figure 17:
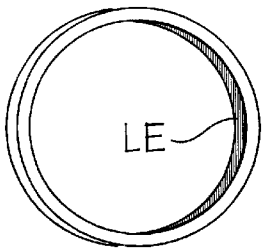
FIG. 17 is a sight picture as seen through the sight apparatus in which the target is misaligned to the left.
Figure 16:
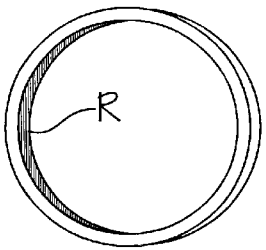
FIG. 16 is a sight picture as seen through the sight apparatus in which the target is misaligned to the right.

When using the present sight apparatus 2, the eye can easily focus on and center the target in the perfect circle created by the alignment of the target in the sight. Unobstructed by the sight apparatus, the target may be the primary focus of the human eye. FIGS. 16 through 20 demonstrate several sight alignments with the target. In FIG. 16, the shadow or view of the inner edge seen in the sight illustrates an alignment error to the right of the target, indicated by R. Similarly, FIG. 17 illustrates an error in alignment to the left, indicated by LE. FIG. 19 illustrates an error in alignment high, indicated by H, and FIG. 20 illustrates an error in alignment too low, indicated by LW. FIG. 18 illustrates a view through the sight when the target is aligned correctly with the eye, indicated by C.

Other characteristics of the sight apparatus provide that if more than 180 degrees of shadow or interior surface of the aperture is seen by the human eye in the circle of the sight, then a tunnel effect is occurring and the sight mechanism 16 may be changed for the circumstances or to accommodate the user's eye. The sight apparatus 2 may be easily configured to provide a combined aperture through the circular members 40 and 42 and sight mechanism 16 of a longitudinal length that a particular human eye can view a target through the proximal circular member 40 without seeing an internal edge of the circular aperture. The distance of the usual target under the circumstances will also effect the desired sight mechanism 16. When the expected target will be far off, then a sight mechanism 16 having a narrower aperture may be desirable to provide more precise targeting with a smaller sight picture. Versus when the expected target will be close up, a sight mechanism 16 having a larger aperture may be desirable to made targeting easier with a larger sight picture. To resolve such problems, the internal sight mechanism 16 may be exchangeable as discussed. In addition the changing to internal sight mechanism 16 to adjust aperture size, the internal sight mechanism 16 may be exchanged for one with closer proximal and distal ends 44 and 46 to reduce tunneling effect or for one with the proximal and distal ends 44 and 46 farther apart to the extent tunneling does not occur to improve the precision of targeting.

The circular members 40 and 42 may be exchanged without changing the sighting alignment by providing access to them through the mounting assembly 8. As shown, the mounting assembly 8 has sloped ends 64 that allow access to circle members 40 and 42 that are screwed into internal sight mechanism 16.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention as defined by the claims.

I claim:

1. A sight apparatus comprising:

a mount;

a sight mechanism including a proximal end and a distal end bounding a central portion and the sight mechanism set in a position within the mount via contact with the central portion;

a circular aperture passing through the proximal end, the central portion, and the distal end of the sight mechanism;

a proximal circular member attached to the proximal end of the sight mechanism and having an aperture with a circumference being aligned in contiguous contact with the circumference of the circular aperture of the sight mechanism;

a distal circular member attached to the distal end of the sight mechanism and having an aperture aligned in contiguous relation to the circular aperture of the sight mechanism.

2. A sight apparatus as in claim 1 in which the proximal circular member and the distal circular member are removable from the sight mechanism.

3. A sight apparatus as in claim 1 in which the mount includes a base and a retaining member, and the retaining member is movable to allow the sight mechanism to be removed from the mount.

4. A sight apparatus comprising:

a mount;

a sight mechanism including a proximal end and a distal end bounding a central portion and the sight mechanism set in a position within the mount via contact with the central portion, and the central portion having an enlarged external girth with respect to the proximal end and the distal end of the sight mechanism;

a circular aperture passing through the proximal end, the central portion, and the distal end of the sight mechanism;

a proximal circular member attached to the proximal end of the sight mechanism and having an aperture aligned in contiguous relation to the circular aperture of the sight mechanism;

a distal circular member attached to the distal end of the sight mechanism and having an aperture aligned in contiguous relation to the circular aperture of the sight mechanism.

5. A sight apparatus as in claim 4 in which the central portion has a slip resistant surface coating.

6. A sight apparatus as in claim 4 in which the central portion is elliptical shaped.

7. A sight apparatus as in claim 6 in which a windage adjustment device and elevation adjustment device are situated on the sight mechanism on either the proximal end or the distal end thereof.

8. A sight apparatus comprising:

a mount having sloped ends;

a sight mechanism including a proximal end and a distal end bounding a central portion and the sight mechanism set in a position within the mount via contact with the central portion;

a circular aperture passing through the proximal end, the central portion, and the distal end of the sight mechanism;

a proximal circular member attached to the proximal end of the sight mechanism and having an aperture aligned in contiguous relation to the circular aperture of the sight mechanism;

a distal circular member attached to the distal end of the sight mechanism and having an aperture aligned in contiguous relation to the circular aperture of the sight mechanism; and the proximal circular member and the distal circular member being removable from the sight mechanism.

9. A sight apparatus comprising:

a mount;

a sight mechanism including a proximal end and a distal end bounding a central portion having an enlarged external girth with respect to the proximal end and the distal end, and the sight mechanism set in a position within the mount via contact with the central portion;

a circular aperture passing through the proximal end, the central portion, and the distal end of the sight mechanism having a perfectly circular interior circumference and being of such a longitudinal length that a human eye can view a target through the proximal end of the sight mechanism without seeing an internal edge of the circular aperture.

10. A sight apparatus as in claim 9 in which the central portion has a slip resistant surface coating.

11. A sight apparatus as in claim 9 in which the central portion is elliptical shaped.

12. A sight apparatus as in claim 9 in which a proximal circular member is attached to the proximal end of the sight mechanism and has an aperture aligned in contiguous relation to the circular aperture of the sight mechanism, a distal circular member is attached to the distal end of the sight mechanism and has an aperture aligned in contiguous relation to the circular aperture of the sight mechanism, and the proximal circular member and the distal circular member are removable from the sight mechanism.

13. A sight apparatus as in claim 12 in which the mount includes a base and a retaining member, and the retaining member is movable to allow the sight mechanism to be removed from the mount, and the retaining member has sloped ends that permit access to the proximal circular member and the distal circular member.

14. A sight apparatus comprising:

a mount having a base and a movable retaining member with open sloped ends;

a sight mechanism including a proximal end and a distal end bounding an elliptical shaped central portion having an enlarged external girth with respect to the proximal end and the distal end, and the sight mechanism set in a position within the mount via contact with the central portion, and the sight mechanism being removable from the mount;

a circular aperture passing through the proximal end, the central portion, and the distal end of the sight mechanism;

a interchangeable proximal circular member attached to the proximal end of the sight mechanism and having an aperture aligned contiguously with the circular aperture of the sight mechanism;

an interchangeable distal circular member attached to the distal end of the sight mechanism and having an aperture aligned contiguously with the circular aperture of the sight mechanism, such that the combination of the proximal circular member, the distal circular member, and the circular aperture of the sight mechanism provide a combined aperture of a length that a human eye can view a target through the proximal circular member without seeing an internal edge of the proximal circular member or the distal circular member.

* * * * *